United States Patent [19]

Bertiller

[11] Patent Number: 4,796,535

[45] Date of Patent: Jan. 10, 1989

[54] ADAPTER CARTRIDGE FOR INSERTION TUBE SYSTEMS

[75] Inventor: Roland Bertiller, Schramberg, Fed. Rep. of Germany

[73] Assignee: Mauser-Werke Oberndorf GmbH, Fed. Rep. of Germany

[21] Appl. No.: 62,450

[22] Filed: Jun. 12, 1987

[30] Foreign Application Priority Data

Jun. 20, 1986 [DE] Fed. Rep. of Germany ..... 3620697

[51] Int. Cl.[4] ..... F42B 5/02; F42B 8/00

[52] U.S. Cl. ..... 102/446; 102/464; 102/467

[58] Field of Search ..... 102/430, 444, 446, 464, 102/466, 467, 469

[56] References Cited

U.S. PATENT DOCUMENTS

| | | | |
|---|---|---|---|
| 2,918,868 | 12/1959 | Ringdal | 102/466 |
| 3,424,089 | 1/1969 | Humpherson | 102/466 |
| 3,749,021 | 7/1973 | Burgess | 102/466 |
| 3,874,294 | 4/1975 | Hale | 102/467 |
| 4,187,271 | 2/1980 | Rolston et al. | 102/466 |
| 4,233,902 | 11/1980 | Hartley et al. | 102/444 |
| 4,276,830 | 7/1981 | Alice | 102/467 |
| 4,620,485 | 11/1986 | Bertiller | 102/446 |
| 4,633,755 | 1/1987 | Bertiller et al. | 102/446 |

FOREIGN PATENT DOCUMENTS

| | | | |
|---|---|---|---|
| 3321233 | 1/1986 | Fed. Rep. of Germany . | |
| 2149070 | 6/1985 | United Kingdom | 102/446 |

*Primary Examiner*—Harold J. Tudor

*Attorney, Agent, or Firm*—McGlew and Tuttle

[57] ABSTRACT

An adapter cartridge for insertion tube systems of firearms has a jacket casing which is made of fiber reinforced plastic that is joined securely to the cylindrical part of a tube base. The tube base has an incircling drawn shell rim that is securely enclosed by a plastic ring.

9 Claims, 1 Drawing Sheet

ADAPTER CARTRIDGE FOR INSERTION TUBE SYSTEMS

FIELD AND BACKGROUND OF THE INVENTION

This invention relates in general to firearms and in particular to a new and useful adapter cartridge for insertion tube systems.

This invention particularly concerns an adapter cartridge for insertion tube systems, comprising a cartridge case, an axially adjoining firing pin sleeve, a cartridge base, and a cylindrical jacket casing.

A similar adapter cartridge is disclosed, for example, by German Pat. No. 33 21 233. The cartridge case, the cartridge base, and the cylindrical jacket are made of metal in this case, for example of brass. However, these brass shells that are used have the drawback of a specific gravity of 8.5 g/cm$^3$, with the total weight of the adapter cartridge being at the allowable upper limit. Another added drawback is the fact that the adapter cartriges are ejected from the gun after the shot as they are and fall into the so-called spent shell box. This leads to damage to the adapter cartridges beneath, which show dents and depressions from the impact of the ejected cartridges and therefore can no longer be loaded after a short time. The relatively costly and valuable brass shell consequently has to be replaced after only a short time.

SUMMARY OF THE INVENTION

The invention provides an adapter cartridge that has only a low weight and also avoids the damage described above from falling on one another.

Pursuant to the invention the cartridge base connected securely to the jacket casing has a drawn shell rim that is securely enclosed by a plastic ring. The cartridge base has a cup-shaped design and has a radially encircling drawn shell rim that is securely enclosed on all sides by a plastic ring which ends about flush with the outer face of the cartridge base, and with the cylindrical wall of the cartridge base being reduced in outside diameter at its end area away from the base, with this end area being connected securely to the jacket casing. The jacket casing pursuant to the invention comprises a fiber-reinforced plastic.

By using fiber-reinforced plastic, the jacket casing is given a specific gravity of only approximately 2 g/cm$^3$, in contrast to the brass shell of the state of the art. This substantially simplifies the handling of the adapter cartridge. The enclosure of the drawn shell rim with a plastic ring avoids the damage to the adapter cartridge on mutual impact. The plastic ring on the drawn shell rim, in spite of its adequate strength, is flexible enough to prevent the formation of nicks and dents, when it strikes another adapter cartridge, and the jacket casing made of fiber-reinforced plastic is so resistant that when struck by other adapter cartridges with a plastic-jacketed drawn shell rim, damage to its surface cannot occur.

Accordingly it is an object of the invention to provide an adapter cartridge for insertion to systems which includes a jacket casing made of a fiber-reinforced plastic having a tube base with a cylindrical part and a base part said base part having an encircling drawn shell rim that is securely enclosed by a plastic ring and said base part being reinforced on its exterior by a fiber-reinforced plastic that is joined securely to said cylindrical part.

A further object of the invention is to provide an adapter cartridge which is simple in design, rugged in construction and economical to manufacture.

The various features of novelty which characterize the invention are pointed out with particularlity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

GENERAL DESCRIPTION OF THE PREFERRED EMBODIMENT

Figure 1:
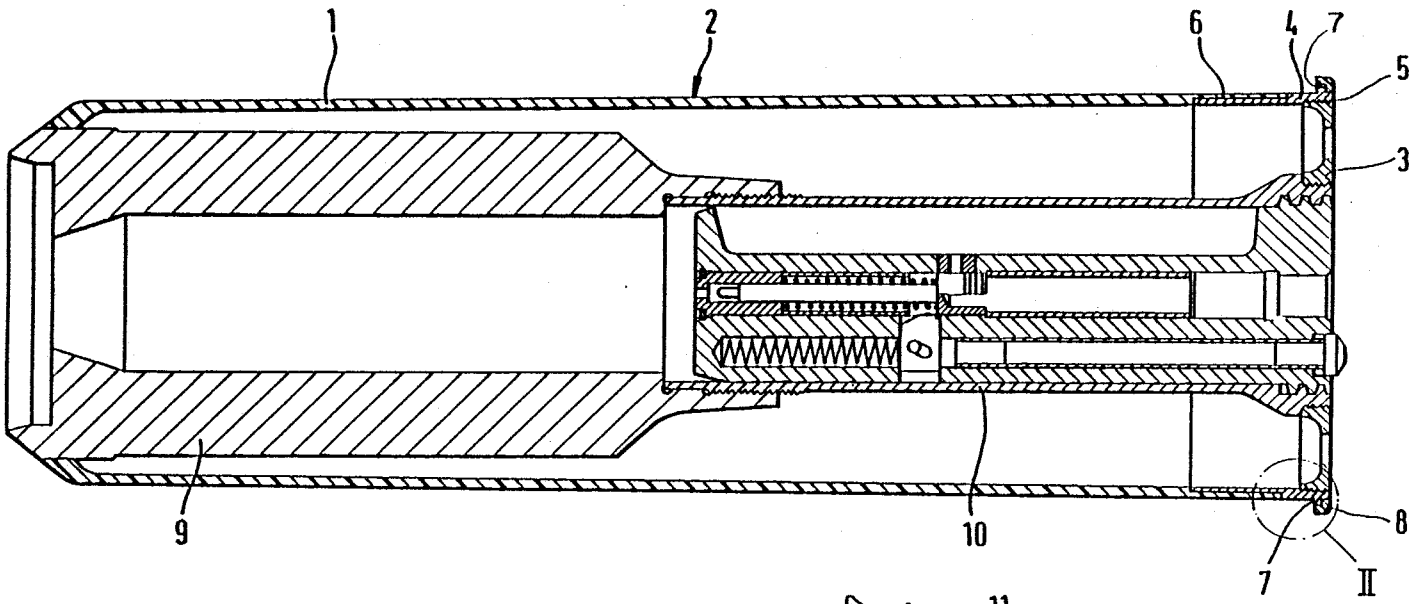
FIG. 1 is an axial sectional view of an adapter cartridge for insertion tube systems constructed in accordance with the invention.
Figure 2:
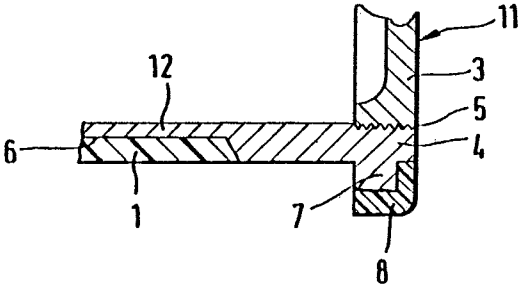
FIG. 2 is an enlarged detailed sectional view of a portion of the adapter cartridge pursuant to II in FIG. 1.

Referring to the drawings in particular the invention embodied therein comprises an adapter cartridge generally designated 2 which contains cartridge chamber 9 having a firing pin sleeve 10 with associated firing pin mechanism.

The adapter cartridges used pursuant to the state of the art are generally equipped with brass shells. In the ejection of such adapter cartridges, the brass shells are knocked against one another so strongly that dents of convex and concave shape are formed in them. This makes it no longer possible to load them into the firing chamber, for example of a combat tank gun, after a short time. The costly brass shell that is expensive to produce has to be replaced by a completely new adapter cartridge after only 20 to 30 uses.

To increase the lifetime and to achieve a weight reduction, the jacket casing 1 is made of a fiber-reinforced plastic by winding, injection, or casting techniques. Such a jacket casing 1 has very good mechanical properties. Permanent deformations are not formed under load. This makes such an adapter cartridge 2 always loadable. The specific gravity of the jacket casing 1 made of fiber-reinforced plastic is approximately 2 g/cm$^3$, because of which the total weight falls within the middle range of the ammunition used.

The jacket casing 1 is connected securely to the cartridge base 11 which is made of steel. To make it possible to use the winding technique for the jacket casing 1, the cartridge base is made in two separately formed parts comprising a cylindrical wall section 4 and a bottom 3, which are immovably connected to one another mechanically.

This separation 5 permits the jacket casing to be made simply on a winding spindle.

The cylindrical wall 4 of the cartridge base 11 has an encircling drawn shell rim 7 with opposite forward and rearward faces joined by a circumferential face. The rearward and circumferential faces are enclosed securely by a plastic ring 8 by casting or extrusion coating. This plastic ring 8 of the drawn shell rim 7 comprises an impact-resistant and abrasion-resistant plastic and thus serves as a shock absorber when the adapter cartridge strikes the trough or the other used adapter cartridges that are in the trough. The jacket casings are therefore under substantially smaller load than is the case with the metal casings according to the state of the art. This substantially increases its lifetime. The spent shell box is also beneficially under less severe strain.

The cylindrical wall 4 of the cartridge base 11 is reduced in outside diameter at its end area 12. The jacket casing 1 is securely connected to the cartridge base 11 in this end area by the winding technique. The winding technique forms a permanent joint 6 between the cylindrical wall 4 and the jacket casing 1. The jacket casing 1 is given very high strength by appropriate curing of the plastic.

Within the jacket casing 1, the cartridge chamber 9 and the firing pin sleeve 10 are located centrally, one behind the other axially.

What is claimed is:

1. An adapter cartridge for insertion tube systems, comprising a cartridge chamber; a firing pin sleeve secured to said chamber and following said chamber in an axially rearward direction; a circular, metal, cartridge base joined to the sleeve to extend transversely thereof and a cylindrical jacket casing made of fiber-reinforced plastic, securely joined to said base and extending over the cartridge chamber, said cartridge base having an encircling drawn shell rim with opposite forward and rearward faces joined by the circumferential face; and, a shock absorbing plastic ring securely enclosing the rearward and circumferential faces only so that the forward face of the rim is exposed.

2. An adapter cartridge according to claim 1 wherein: said cartridge base is cup-shaped and comprises a cylindrical wall portion that is reduced in outside diameter and wherein said jacket casing is securely seated on said portion of reduced outside diameter.

3. An adapter cartridge according to claim 2 wherein: said fiber-reinforced plastic is seated on said portion of reduced outside diameter as a winding therearound.

4. An adapter cartridge according to claim 1 wherein the cartridge base has an outer, bottom, rearmost face and said plastic ring comprises an extension-coating on the drawn shell rim ending flush with the outer bottom face.

5. An adapter cartridge according to claim 1 wherein: said fiber-reinforced plastic of said jacket casing has a specific gravity of approximately 2 g/cm.

6. An adapter cartridge according to claim 1 wherein said cartridge base is made of steel.

7. An adapter cartridge according to claim 1 wherein said cartridge base has two separately formed parts comprising a bottom part and a cylindrical wall portion joined securely to said bottom part to outstand axially forwardly therefrom and to which the jacket casing is secured as a winding.

8. An adapter cartridge for insertion tube systems, comprising a cartridge chamber; a firing pin sleeve secured to said chamber and following said chamber in axially rearward direction; a circular, metal, cartridge base joined to the sleeve to extend transversely thereof; a cylindrical jacket casing made of fiber-reinforced plastic, said cartridge base having two separately formed parts comprising a bottom part and a cylindrical wall portion ;joined securely to said bottom part to outstand axially forwardly therefrom and being formed with a portion having a reduced outside diameter around which reduced diameter portion the fiber-reinforced plastic is wound, securely joined thereto, with the jacket casing extending over the cartridge chamber; the base having an encircling rim with opposite, forward and rearward faces, joined by a circumferential face; and, a shock absorbing plastic ring securely enclosing the rearward and circumferential faces only with the forward face of the ring being exposed.

9. An adapter cartridge according to claim 8 wherein the rim is formed on the cylindrical wall portion at a location adjacent the bottom part of the base.

* * * * *